US007793445B2

(12) United States Patent
Lawrence

(10) Patent No.: US 7,793,445 B2
(45) Date of Patent: Sep. 14, 2010

(54) INFINITELY VARIABLE COMMEMORATIVE COIN

(76) Inventor: Lonnie L. Lawrence, 1024 N. County Rd. W., Odessa, TX (US) 79763

( * ) Notice: Subject to any disclaimer, the term of this patent is extended or adjusted under 35 U.S.C. 154(b) by 95 days.

(21) Appl. No.: 12/364,028

(22) Filed: Feb. 4, 2009

(65) Prior Publication Data

US 2010/0192430 A1 Aug. 5, 2010

(51) Int. Cl.
*G09F 3/02* (2006.01)

(52) U.S. Cl. ..... 40/27.5; 40/323; 40/661.01

(58) Field of Classification Search ..... 40/27.5, 40/323, 661.01, 661.05; 206/0.8, 818; 63/1.16
See application file for complete search history.

(56) References Cited

U.S. PATENT DOCUMENTS 2,659,169 A * 11/1953 Brennan ..... 40/1.5
4,604,819 A * 8/1986 Grey ..... 40/1.5
4,810,539 A * 3/1989 Todd ..... 428/7
4,827,640 A * 5/1989 Jones ..... 40/27.5
5,406,264 A * 4/1995 Plonsky et al. ..... 235/493
5,806,346 A * 9/1998 Schlinger et al. ..... 63/40
6,205,816 B1 * 3/2001 Lu ..... 63/1.16
6,508,466 B1 * 1/2003 Rendleman ..... 273/148 R
6,868,630 B2 * 3/2005 Kim ..... 40/711
7,194,828 B2 * 3/2007 Peterson et al. ..... 40/1.5
2003/0084596 A1 * 5/2003 Zurawski et al. ..... 40/27.5
2004/0255501 A1 * 12/2004 Lawrence et al. ..... 40/665
2006/0101676 A1 * 5/2006 Ratmansky et al. ..... 40/27.5

* cited by examiner

*Primary Examiner*—Lesley Morris
*Assistant Examiner*—Christopher E Veraa
(74) *Attorney, Agent, or Firm*—Office of Tim Cook P.C.

(57) ABSTRACT

A body comprising a ring and a diametric bridging member is adapted to receive and retain dissimilar markers or indicia on the opposing sides of the body. The bridge member diametrically spans the void within the ring member. The bridge member preferably includes a hole to receive a permanent magnet. The ring member is adapted to receive first and second indicia, each of which is formed of iron or an iron alloy. The first and second indicia are held within the ring member by the magnet, and lie flush with the outer top and bottom surfaces of the ring member to present the appearance of a single article of manufacture. If desired, the first and second markers may be replaced with other markers, thereby altering the appearance of the coin flip token.

6 Claims, 1 Drawing Sheet

INFINITELY VARIABLE COMMEMORATIVE COIN

FIELD OF THE INVENTION

The present invention relates generally to the field of coin flip tokens or coins, and, more particularly, to flexible structure for a coin flip token which is infinitely variable in the indicia commonly referred to heads and tails.

BACKGROUND OF THE INVENTION

At the start of many sporting events, such as a football game, a coin or token is often tossed into the air and allowed to fall, with even odds as to whether one side of the coin or token will land face up. The result of the coin flip determines, in part, how the sporting event begins, such as which team will receive the first kickoff and which team will defend which end of the field. The same sort of coin flip is often used to determine which of two alternatives is to be selected, when the result of the coin flip is completely random.

For most of these types of coin flips, a simple coin such as a half dollar is used. For sporting events of most significance, such as a championship game, a commemorative coin is often produced, with income from the sales of copies of the coin helping to defray the costs of the event. However, such commemorative coins have always in the past been made as a single article of manufacture, typically by pressing a blank in a die press. In other words, once the coin to pressed, the heads and the tails sides are set in place forever.

Commemorative coins do not have to be a flip coin and have for a long time been used by the military to represent a tight bond between members of military units. Such commemorative coins or challenge coins have been used on the battlefield to identify soldiers to other units as well. Their popularity has spread to teams and clubs. Recognizing that challenge coins build team spirit, preserve unity and encourage stronger ties; many other organizations have begun issuing custom challenge coins to bolster these traits including fraternities, sororities, associations, clubs, organizations and so on.

Thus, there remains a need for a coin token that may be altered or varied to accommodate different events, or at the pleasure of the user or owner of the token. The present invention is directed to filling this need in the art.

SUMMARY OF THE INVENTION

The present invention solves this need in the art by providing a body adapted to receive and retain dissimilar markers, referred to herein as indicia, on the opposing sides of the body. The body preferably includes a ring member and a spoke or diametrically bridge member, spanning diametrically within the ring member. The bridge member preferably includes a hole to receive a permanent magnet. The ring member is adapted to receive first and second indicia, each of which is formed of iron or an iron alloy. The first and second markers are held within the ring member by the magnet, and lie flush with the outer surface of the ring member to present the appearance of a single article of manufacture. If desired, the first and second markers may be replaced with other markers, thereby altering the appearance of the coin flip token.

These and other features and advantages of this invention will be readily apparent to those skilled in the art.

BRIEF DESCRIPTION OF THE DRAWINGS

So that the manner in which the above recited features, advantages and objects of the present invention are attained and can be understood in detail, more particular description of the invention, briefly summarized above, may be had by reference to embodiments thereof which are illustrated in the appended drawings.

DETAILED DESCRIPTION OF A PREFERRED EMBODIMENT

Figure 1:
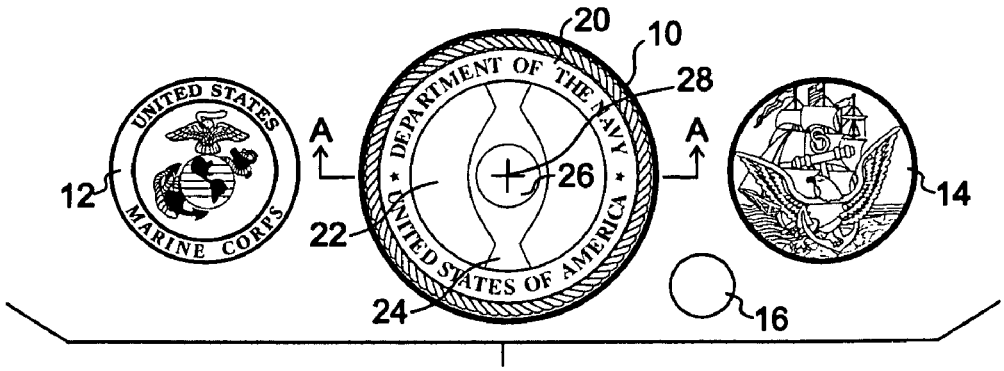
FIG. 1 is a plan view of the four component parts which make up a coin token in accordance with the teachings of this invention.
Figure 2:
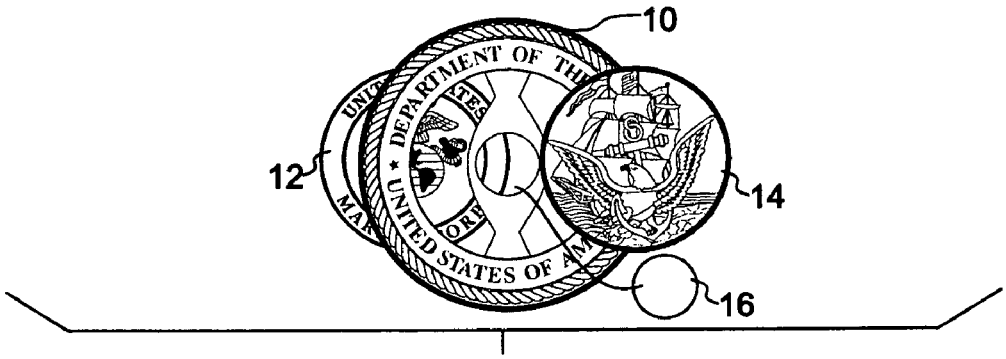
FIG. 2 is a plan view of the components, illustrating the arrangement of the components as they are assembled.

FIG. 1 depicts the kit of the various components which serve to make up the commemorative coin of this invention. The component parts include a body 10, a first removable indicia 12, a second removable indicia 14 which is different than the indicia 12, and a permanent magnet 16. FIG. 2 illustrates these components as they are brought together to form a commemorative coin, and it is understood that the image shown on the indicia 12 will be visible on the back side of the coin. It is shown as facing the body 10 for illustration purposes, only.

The body 10 comprises an annular ring 20 of any appropriate material, including plastic or metal, or other material. The ring 20 may display an image, if desired, or be plain. The ring 20 defines an open void 22, whose function will be described below in respect of FIGS. 3A and 3B. The void 22 thus defines a gap between the indicia 12 and 14 and the ring 20. A diametric bridge element 24 extends across the void 22, and the bridge element 24 includes a magnet receiving hole 26. The hole 26 is centered on a centerline 28 which is coincident with and perpendicular to the center of the annular ring 20. The hole 26 is sized to receive the magnet 16, preferably by press fit or other appropriate securing means. Alternatively, the hole may be eliminated and a magnet secured to both sides of the bridge element.

Figure 3A:
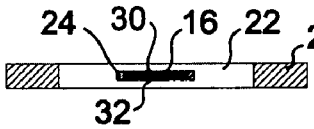
FIG. 3A is a side section view of the ring member taken along section lines 3A-3A of FIG. 1.
Figure 3B:
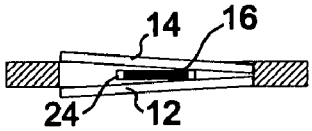
FIG. 3B is a side section view of the ring member with markers in place, illustrating how to exchange markers in the ring member.
Figure 4:
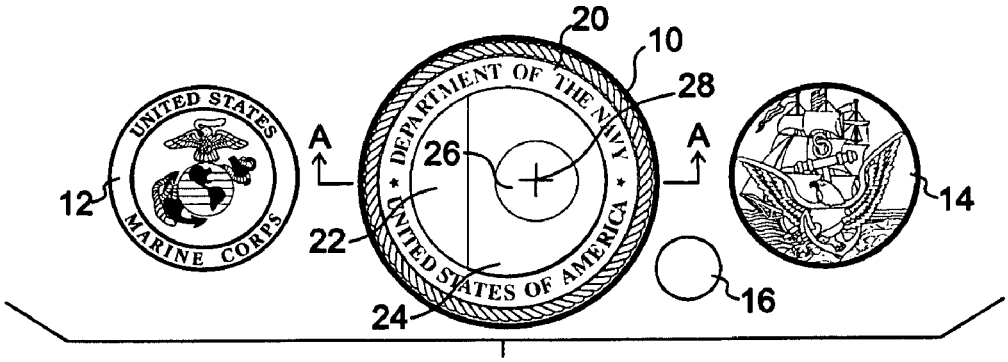
FIG. 4 is a plan view of the four component parts which make up a coin token in accordance with the teachings of this invention, wherein the magnet is offset from the center of the coin.
Figure 5:
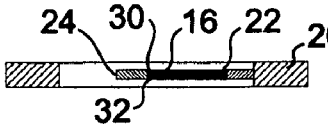
FIG. 5 is a side section view of the ring member taken along section lines A-A of FIG. 4.

Referring now to FIGS. 3A and 3B, side section views of the commemorative coin are shown. In FIG. 3A, the first removable indicia 12 and the second removable indicia 14 are removed, so that the relationship of the void 22, the bridge element 24, and the magnet may be more clearly understood. In FIG. 3B, the indicia 12 and 14 are shown with one side of the indicia forced away from abutting quiescent contact with the magnet 16. Thus, the sides of the indicia may be forced into the void, making it easier to remove and replace the indicia.

It should also be noted that the magnet 16 defines an top surface 30 to retain the indicia 14 and a bottom surface 32 to retain the indicia 12. The sum of the thicknesses of the indicia and the magnet should be approximately equal to the thickness of the ring 20. Also, the magnet should be mounted in the bridge member 24 so that it is equidistant from the top and bottom surfaces of the ring.

If desired, the ring element may include an identifying event, such as a championship game, and the indicia 12 and 14 may identify the opponents of that game. Thus, rather than a selected captain of an opposing team calling "heads" or "tails", the referee would toss the commemorative coin into the air and the winner of the toss will be identify by which indicia lands face up.

The principles, preferred embodiment, and mode of operation of the present invention have been described in the foregoing specification. This invention is not to be construed as limited to the particular forms disclosed, since these are regarded as illustrative rather than restrictive. Moreover, variations and changes may be made by those skilled in the art without departing from the spirit of the invention.

I claim:

1. A coin comprising:

a. a ring defining a void therein, the ring having an axial centerline perpendicular to the ring;

b. a bridge member spanning the void through the centerline;

c. a hole in the bridge member concentric with the centerline of the ring;

d. a permanent magnet in the hole, the magnet defining a top surface and a bottom surface;

e. a first removable indicia adapted to be retained on the top surface of the magnet; and f. a second removable indicia adapted to be retained on the bottom surface of the magnet.

2. The coin of claim 1, further comprising a gap between the first and second removable indicia between the magnet and the ring.

3. A coin comprising:

a. a ring defining a void therein, the ring having a centerline;

b. a bridge member spanning the void through the centerline;

c. a hole in the bridge member on either side of the centerline;

d. a permanent magnet in the hole, the magnet defining a top surface and a bottom surface;

e. a first removable indicia adapted to be retained on the top surface of the magnet; and f. a second removable indicia adapted to be retained on the bottom surface of the magnet.

4. The coin of claim 3, further comprising a gap between the first and second removable indicia between the magnet and the ring.

5. A coin comprising:

a. a ring defining a void therein, the ring having an axial centerline perpendicular to the ring;

b. a bridge member spanning the void through the centerline, the bridge element defining a top side and a bottom side;

c. a first permanent magnet on the top side of the bridge member, the first magnet defining a top surface;

d. a second permanent magnet on the bottom side of the bridge member, the second magnet defining a bottom surface;

e. a first removable indicia adapted to be retained on the top surface of the first permanent magnet; and f. a second removable indicia adapted to be retained on the bottom surface of the second permanent magnet.

6. The coin of claim 5, further comprising a gap between the first and second removable indicia between the magnet and the ring.

* * * * *